US010588804B2

(12) United States Patent
Huang

(10) Patent No.: US 10,588,804 B2
(45) Date of Patent: Mar. 17, 2020

(54) HANDBARROW FOR CARRYING PATIENTS

(71) Applicant: APEX HEALTH CARE MFG., INC., Chiayi County (TW)

(72) Inventor: Chi-Tzung Huang, Chiayi County (TW)

(73) Assignee: Apex Health Care Mfg., Inc., Chiayi County (TW)

( * ) Notice: Subject to any disclaimer, the term of this patent is extended or adjusted under 35 U.S.C. 154(b) by 231 days.

(21) Appl. No.: 15/892,811

(22) Filed: Feb. 9, 2018

(65) Prior Publication Data

US 2019/0247256 A1 Aug. 15, 2019

(51) Int. Cl.
*A61G 7/10* (2006.01)

(52) U.S. Cl.
CPC ..... *A61G 7/1025* (2013.01); *A61G 7/1017* (2013.01); *A61G 7/1046* (2013.01); *A61G 7/1059* (2013.01); *A61G 7/1063* (2013.01); *A61G 7/1096* (2013.01)

(58) Field of Classification Search
CPC ..... A61G 7/1025; A61G 7/1017
See application file for complete search history.

(56) References Cited

U.S. PATENT DOCUMENTS

2017/0027794 A1* 2/2017 Andersson ..... A61G 7/1017

FOREIGN PATENT DOCUMENTS

TW M240205 8/2004
TW M552807 U 12/2017

* cited by examiner

*Primary Examiner* — Robert G Santos
*Assistant Examiner* — Adam C Ortiz
(74) *Attorney, Agent, or Firm* — Rosenberg, Klein & Lee

(57) ABSTRACT

A retractable structure of a suspension rack of a handbarrow for carrying patients is disclosed herein. It mainly comprises a pedestal, two supporting rods disposed at one end of the pedestal for opening and closing, a main rod having a first end disposed at the other end of the pedestal and a second end, and a retractable structure of a suspension rack connected to the second end of the main rod and having a fixed tube, an active tube, a power source and a control assembly. The power source is disposed within the fixed tube and the active tube and driven to control extension and shrinkage of the active tube by the control assembly activated by a press button of the active tube.

6 Claims, 8 Drawing Sheets

HANDBARROW FOR CARRYING PATIENTS

BACKGROUND OF THE INVENTION

1. Field of the Invention

The present invention relates to a handbarrow for carrying patients which increases activity space of the suspension rack in use, so the handbarrow can be controlled easily to carry patients.

2. Description of Related Art

Generally, in order to easily move critical ill or disabled patients, medical facilities are usually equipped with patient transport racks to make them convenient for transporting patients to a predetermined position by medical staffs.

For instance, the Taiwan patent TWM240205 (U), issued on 11 Aug. 2004, disclosed an improved handbarrow for carrying patients, and the Taiwan patent TW M552807 (U), issued on 11 Dec. 2017, disclosed a handbarrow structure for carrying patients.

Although the traditional patient transport handbarrows mentioned above can achieve the expected effect of assisting healthcare staffs in moving patients easily, they still have many disadvantages in the actual operation of use:

1. The traditional handbarrow uses a bending section to connect an inserting section at a base of a main strut, so a hanging space below a hanging rack is limited by the bending section. Moreover, the bending section may first collide with a hospital bed when the handbarrow is near the bedside, which results in a distance between the transport handbarrow and the hospital bed and cannot be completely close to the hospital bed. When a transport handbarrow is used to suspend a patient, patient's foot often bumps into the bending section.

2. The traditional handbarrow uses a bending section to connect an inserting section at a base of a main strut and a convex lug to movably and pivotally connect a hanger rod at a top of the main strut and has a hanging rack movably disposed at a front end of the hanger rod for hoisting patients, so the patient transport handbarrow easily leans forward when it hangs a heavier patient.

SUMMARY OF THE INVENTION

In view of the above-mentioned problems, the object of the present invention is to provide a handbarrow for carrying patients which increases activity space of the suspension rack in use, so the handbarrow can be controlled easily to carrying patients.

Disclosed herein is a handbarrow for carrying patients. It mainly comprises a pedestal; two supporting rods disposed at one end of the pedestal for opening or closing by moving towards or departing from each other; a main rod having a first end disposed at the other end of the pedestal and a second end; a retractable suspension rack correspondingly and pivotally connected to the second end of the main rod.

The retractable suspension rack comprises a fixed tube having a first end pivotally connected to the main rod and a second end, an active tube, a power source having an end connected with a control valve, and a control assembly connected to the end of the power source. The power source is disposed within the fixed tube and the active tube and driven to control extension and shrinkage of the active tube by the control assembly activated by a press button of the active tube, so as to achieve efficacy of easy operation and increase the scope of applications.

According to an embodiment of the present invention, a lifting mechanism is provided between the main rod and the fixed tube of the retractable suspension rack for controlling up and down displacement of the retractable suspension rack.

According to an embodiment of the present invention, the control assembly is provided with a first block body connected to the press button, a second block body pivotally connected to the active tube and having an end for correspondingly positioning the end connected with the control valve of the power source, a first link block pivotally connected to the first block body and connected to and controlled by the press button, a second link block pivotally connected to the first block body, a connecting rod disposed between the first link block and the second link block, a controlling cord connected to the second link block and correspondingly positioned by the end of the second block body, and a resist piece disposed on the second block body and one side of the end connected with the control valve of the power source and having an end connected to the controlling cord According to an embodiment of the present invention, a flat plate is provided between the pedestal and the two supporting rods for putting a patient's feet thereon, and one side of the flat plate is pivotally connected with a movable and height-adjustable cushion pad.

According to an embodiment of the present invention, the flat plate is provided with a pivot seat having an adjusting slot thereon, and the cushion pad is provided with a joint portion corresponding to the pivot seat and having a protrusion corresponding to the adjusting slot for moving in the adjusting slot.

DETAILED DESCRIPTION OF THE PREFERRED EMBODIMENT

Figure 1:
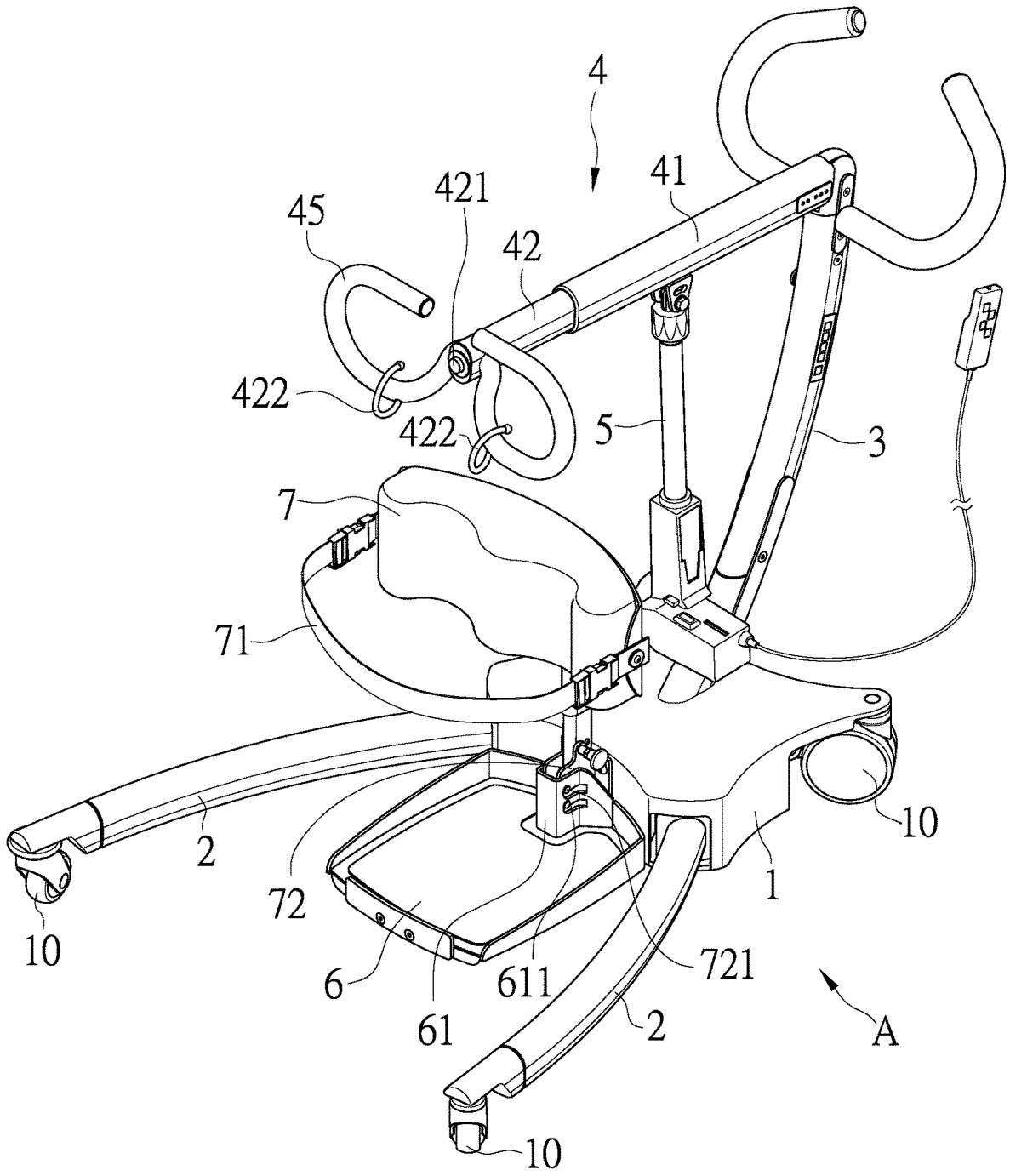
FIG. 1 is a stereogram showing a handbarrow for carrying patients according to the present invention.
Figure 2:
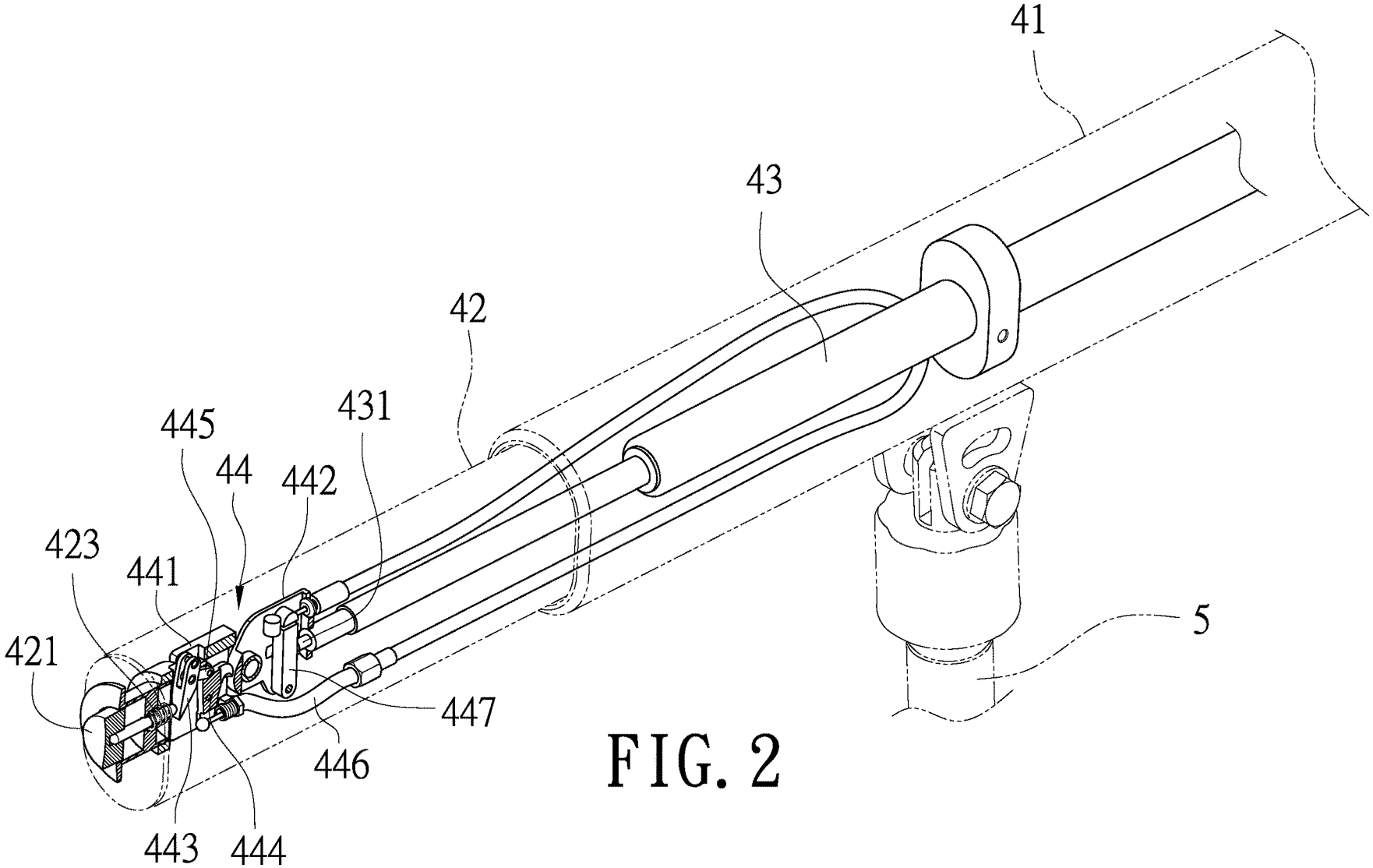
FIG. 2 is a perspective view showing a retractable suspension rack in assembly according to the present invention.
Figure 3:
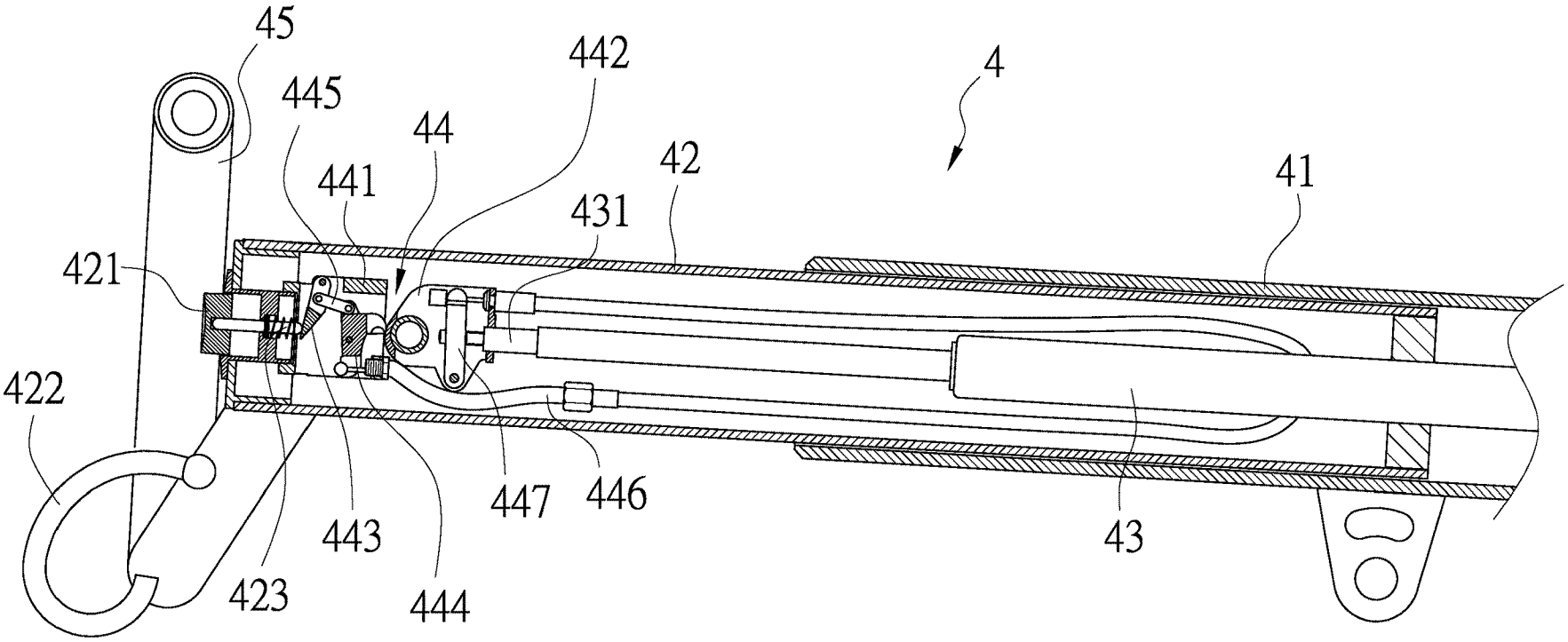
FIG. 3 is a cross-sectional view showing a handbarrow for carrying patients according to the present invention.
Figure 4:
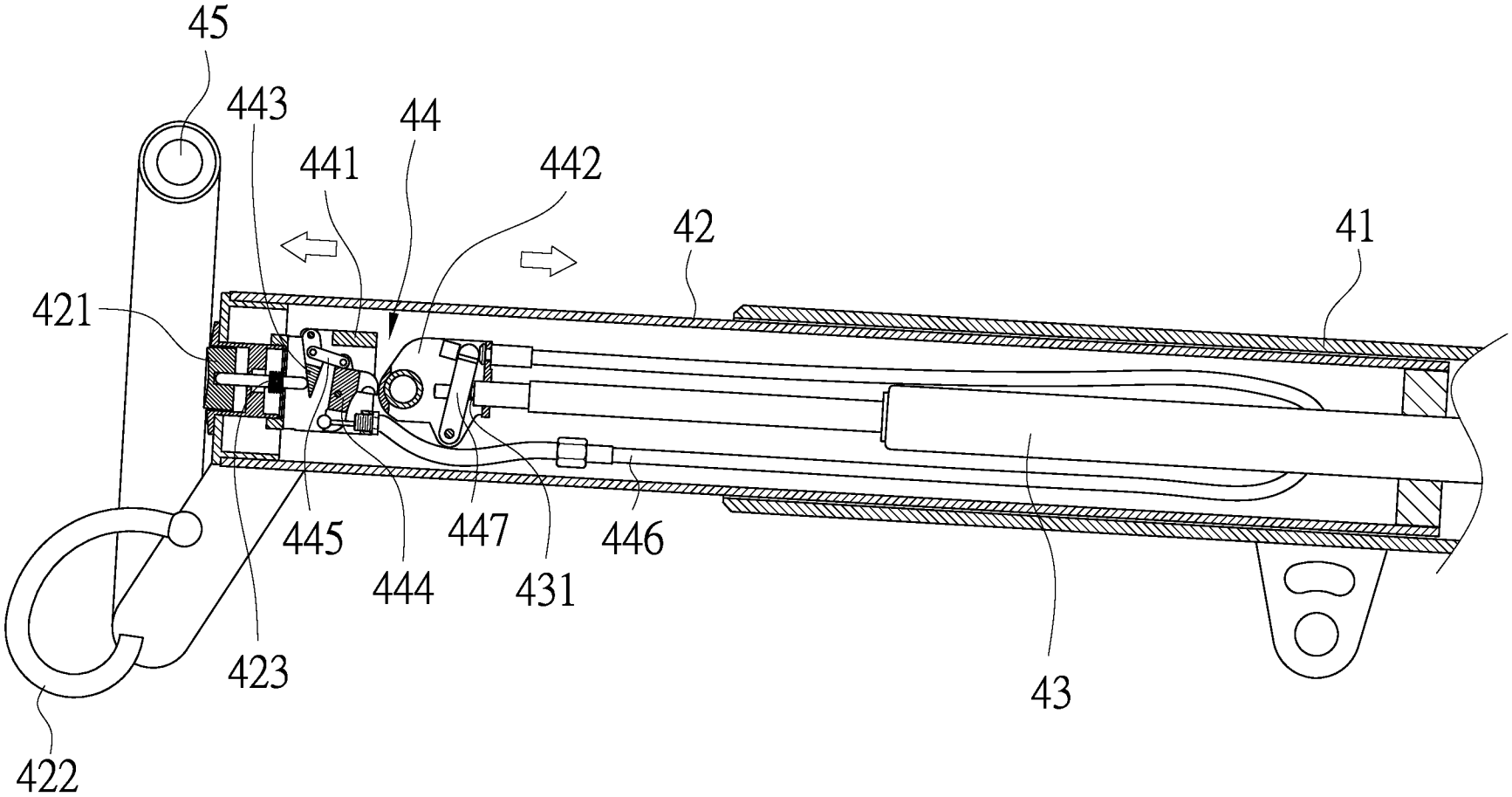
FIG. 4 is a cross-sectional view showing a handbarrow for carrying patients is use according to the present invention.
Figure 5:
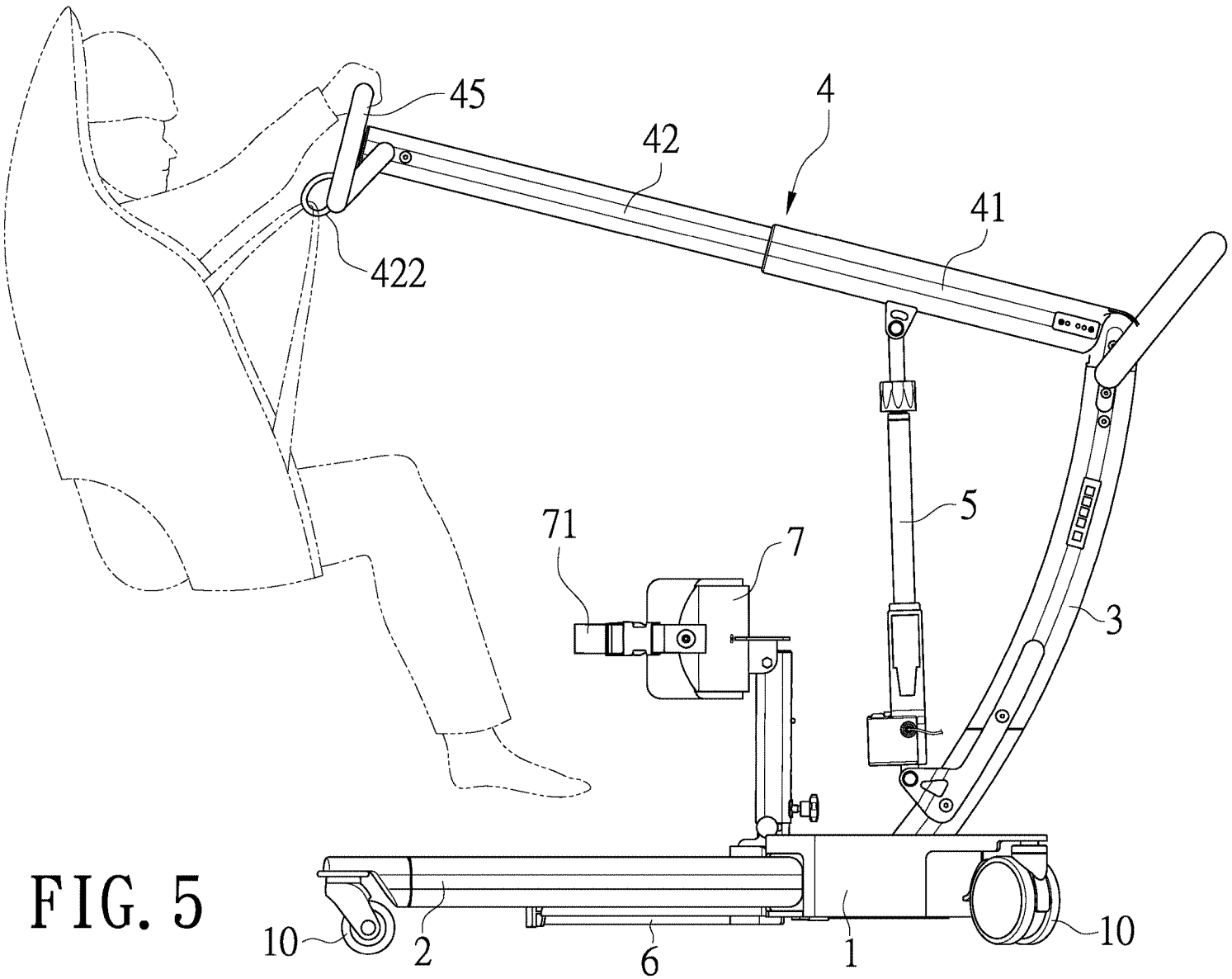
FIG. 5 is a first schematic diagram showing a retractable suspension rack hoists a patient.
Figure 6:
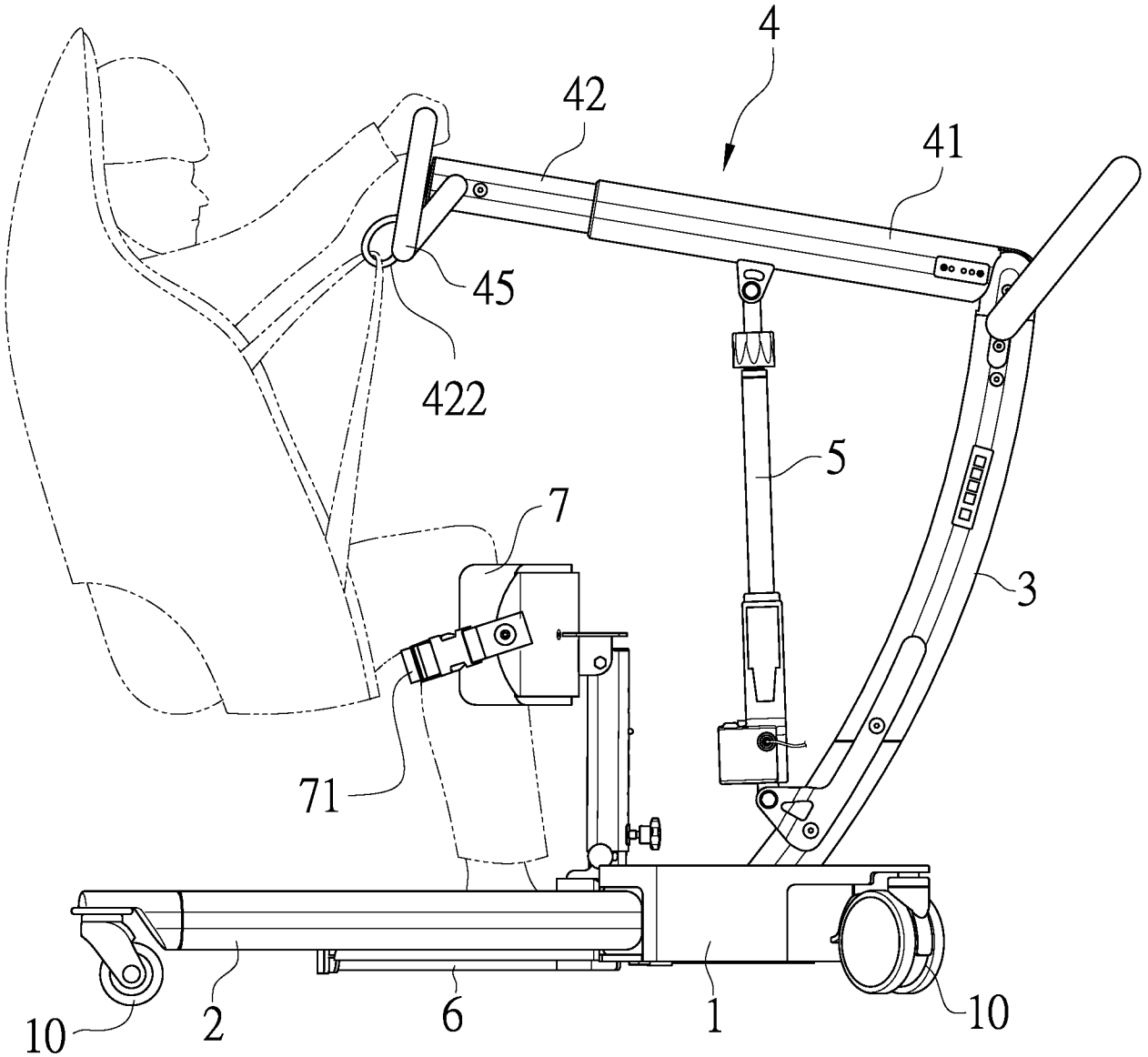
FIG. 6 is a second schematic diagram showing a retractable suspension rack hoists a patient.

Hereinafter, an exemplary embodiment of the present invention will be described in detail with reference to the accompanying drawings.

As showed in FIG. 1 to FIG. 4, a handbarrow for carrying patients (A) according to the present invention is disclosed herein. It mainly comprises a retractable suspension rack (4) for lifting a patient.

The retractable suspension rack (4) comprises a fixed tube (41) having a first end pivotally connected to a main rod (3)

and a second end, an active tube (42) disposed inside the second end of the fixed tube (41) for moving in and out relative to the fixed tube (41), a power source (43) disposed in the fixed tube (41) and the active tube (42) and having an end connected with a control valve (431), and a control assembly (44) connected to the end of the power source (43). The active tube (42) is provided with a press button (421) and a hanging hook (422) at an outer-lateral end thereof, a return spring (423) disposed in the press button (421) for rebounding to an original position of the press button (421). Furthermore, the control assembly (44) is provided with a first block body (441) connected to the press button (421), a second block body (442) pivotally connected to the active tube (42), a first link block (443) pivotally connected to the first block body (441) and connected to and controlled by the press button (421), a second link block (444) pivotally connected to the first block body (441), a connecting rod (445) disposed between the first link block (443) and the second link block (444), a controlling cord (446) connected to the second link block (444), and a resist piece (447) disposed on the second block body (442) and one side of the end connected with the control valve (431) of the power source (43). The second block body (442) has an end for correspondingly positioning the end connected with the control valve (431) of the power source (43) and correspondingly positioning the controlling cord (446). The resist piece (447) has an end connected to the controlling cord (446). The controlling cord (446) can drive the resist piece (447) to move and further press the end connected with the control valve (431) of the power source (43) so that the control valve (431) of the power source (43) can release pressure and conduct a retractable displacement freely.

As shown in FIG. 1 to FIG. 6, in a practical use of the present invention, a handbarrow for carrying patients (A) comprises: a pedestal (1), two supporting rods (2) disposed at one end of the pedestal (1) for opening or closing by moving towards or departing from each other, the main rod (3) having a first end disposed at the other end of the pedestal (1) and a second end, the retractable suspension rack (4) pivotally connected to the second end of the main rod (3), and a lifting mechanism (5) disposed between the main rod (3) and the retractable suspension rack (4) for controlling up and down displacement of the retractable suspension rack (4). Furthermore, bottoms of the pedestal (1) and the two supporting rods (2) are all respectively provided with a wheel body (10). In hoisting a patient, the handbarrow is moved close to a hospital bed (or a patient's location), the pedestal (1) and the two supporting rods (2) are adjusted to a different extent of opening as needed by the patient, and then the lifting mechanism (5) is used to correspondingly adjust the lifting height of the retractable suspension rack (4).

To hoist a patient, the press button (421) is pressed first to loosen the control valve (431) of the power source (43) and allow the active tube (42) to be freely pulled out to a suitable position. After the active tube (42) is pulled out to the suitable position, the press button (421) is released. In such a case, the control valve (431) locks the power source (43) and restricts the active tube (42) from moving. A sling for covering and loading the patient is hooked on the hanging hook (422) at the outer-lateral end of the active tube (42) to suspend the patient. Moreover, the outer-lateral end of the active tube (42) is further provided with a handle (45) for hand grip securely by the patient. At this time, the press button (421) can be pressed to push the first link block (443) of the control assembly (44) and to drive the connecting rod (445), causing a rotational displacement of the second block body (442). When the controlling cord (446) moves simultaneously and pulls the resist piece (447), the resist piece (447) is rotated to press the end connected with the control valve (431) of the power source (43). Accordingly, the power source (43) can release pressure and conduct a retractable action freely.

After the press button (421) is pressed, the active tube (42) is contracted inwards so that the patient can be transferred close to the handbarrow and positioned. Then the press button (421) is released to let the control valve (431) lock the power source (43) and restrict the active tube (42) from being contracted. A flat plate (6) is also provided between the pedestal (1) and the two supporting rods (2) for putting a patient's feet. One side of the flat plate (6) is pivotally connected with a movable and height-adjustable cushion pad (7), and the cushion pad (7) is provided with a retaining belt (71) for adjusting tightness and assisting in positioning the hanging patients for delivery.

Figure 7:
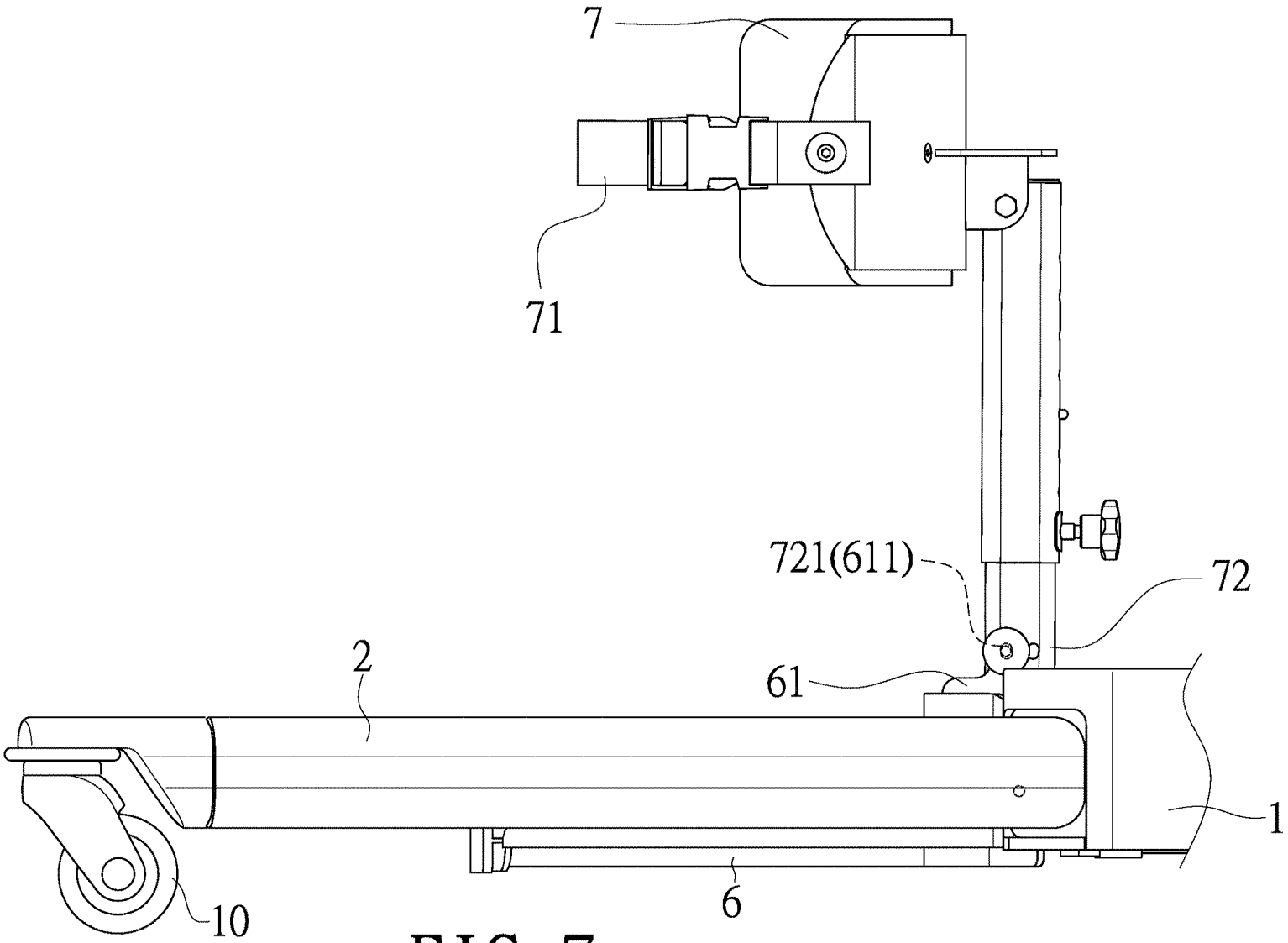
FIG. 7 is a schematic diagram showing a cushion pad according to the present invention.
Figure 8:
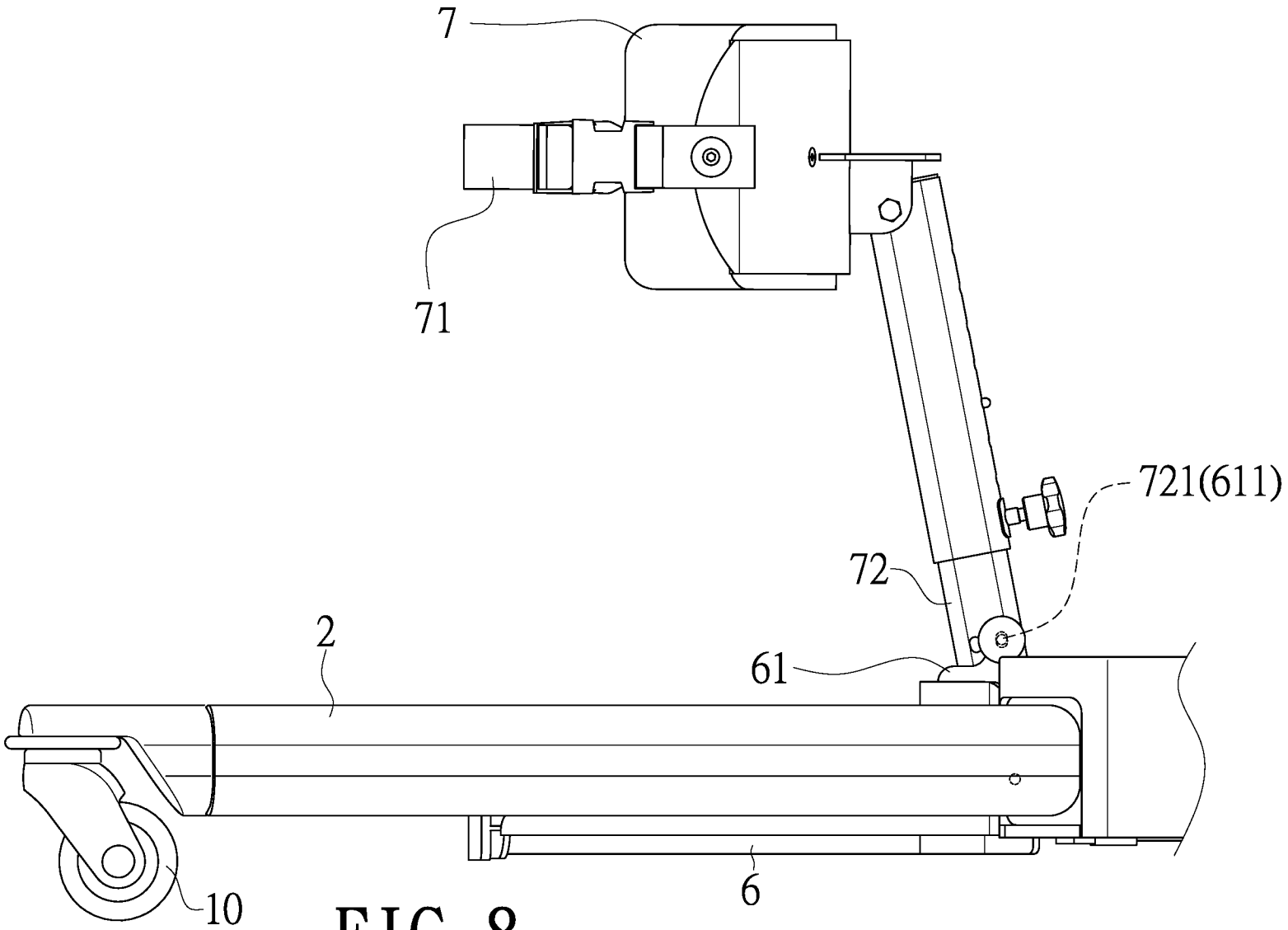
FIG. 8 is a schematic diagram showing an inclination angle of a cushion pad is adjusted according to the present invention.

Referring to FIG. 7 and FIG. 8, a pivot seat (61) having an adjusting slot (611) is provided on the flat plate (6). The cushion pad (7) is provided with a joint portion (72) corresponding to the pivot seat (61), and the joint portion (72) is provided with a protrusion (721) corresponding to the adjusting slot (611) for moving in the adjusting slot (611) and adjusting an inclination angle of the cushion pad (7).

Compared with the technique available now, the present invention has the following advantages:

1. An active tube of a retractable suspension rack of the present invention can be actively extension and shrinkage in a hanging space of hanging a patient, which effectively increases the scope of use even in a place or a space difficult to hang, and increase the effectiveness of hanging.

2. A design of a press button of the present invention can be used to easily and precisely control a lock or a release of a power source, which ensures the effectiveness of a secure suspension for patients.

3. A design of a press button of the present invention can be switched by a simple pressing to effectively adjust the active tube, which achieves the purpose of simple operation.

What is claimed is:

1. A retractable structure of a suspension rack of a handbarrow for carrying patients, comprising:

a pedestal;

two supporting rods disposed at one end of the pedestal for opening or closing by moving towards or departing from each other;

a main rod having a first end disposed at the other end of the pedestal and a second end;

a retractable structure of a suspension rack correspondingly and pivotally connected to the second end of the main rod and comprising a fixed tube having a first end pivotally connected to the main rod and a second end, an active tube, a power source disposed in the fixed tube and the active tube and having an end connected with a control valve, and a control assembly connected to the end of the power source, wherein the active tube is disposed inside the second end of the fixed tube for moving in and out relative to the fixed tube and provided with a press button and a hanging hook at an outer-lateral end thereof, a return spring disposed in the press button for rebounding to an original position of the press button; and wherein the control assembly is provided with a first block body connected to the press button, a second block body pivotally connected to the active tube and having an end for correspondingly positioning the end connected with the control valve of the power source, a first link block pivotally connected to the first block body and connected to and controlled by the press button, a second link block pivotally connected to the first block body, a connecting rod disposed between the first link block and the second link block, a controlling cord connected to the second link block and correspondingly positioned by the end of the second block body, and a resist piece disposed on the second block body and one side of the end connected with the control valve of the power source and having an end connected to the controlling cord; and a lifting mechanism disposed between the main rod and the retractable structure for controlling up and down displacement of the retractable structure.

2. As the retractable structure of a suspension rack of a handbarrow for carrying patients claimed in claim 1, wherein the pedestal and the two supporting rods are respectively provided with a wheel body at a bottom thereof.

3. As the retractable structure of a suspension rack of a handbarrow for carrying patients claimed in claim 2, wherein the outer-lateral end of the active tube is further provided with a handle for hand grip.

4. As the retractable structure of a suspension rack of a handbarrow for carrying patients claimed in claim 3, wherein a flat plate is provided between the pedestal and the two supporting rods for putting a patient's feet thereon, and wherein one side of the flat plate is pivotally connected with a movable and height-adjustable cushion pad.

5. As the retractable structure of a suspension rack of a handbarrow for carrying patients claimed in claim 4, wherein the cushion pad is provided with a retaining belt for adjusting tightness.

6. As the retractable structure of a suspension rack of a handbarrow for carrying patients claimed in claim 5, wherein the flat plate is provided with a pivot seat having an adjusting slot thereon, and wherein the cushion pad is provided with a joint portion corresponding to the pivot seat and having a protrusion corresponding to the adjusting slot for moving in the adjusting slot.

* * * * *